US007813102B2

(12) United States Patent
Gefter et al.

(10) Patent No.: US 7,813,102 B2
(45) Date of Patent: Oct. 12, 2010

(54) PREVENTION OF EMITTER CONTAMINATION WITH ELECTRONIC WAVEFORMS

(75) Inventors: Peter Gefter, South San Francisco, CA (US); Scott Gehlke, Berkeley, CA (US); Lawrence Levit, Alamo, CA (US)

(73) Assignee: Illinois Tool Works Inc., Glenview, IL (US)

( * ) Notice: Subject to any disclaimer, the term of this patent is extended or adjusted under 35 U.S.C. 154(b) by 299 days.

(21) Appl. No.: 12/075,967

(22) Filed: Mar. 14, 2008

(65) Prior Publication Data

US 2008/0225460 A1 Sep. 18, 2008

Related U.S. Application Data

(60) Provisional application No. 60/918,512, filed on Mar. 17, 2007.

(51) Int. Cl.
*H05F 3/00* (2006.01)

(52) U.S. Cl. ..... 361/213; 361/235

(58) Field of Classification Search ..... 361/212, 361/213, 229, 235

See application file for complete search history.

(56) References Cited

U.S. PATENT DOCUMENTS

| | | | | |
|---|---|---|---|---|
| 4,689,715 | A * | 8/1987 | Halleck | 361/213 |
| 5,116,583 | A | 5/1992 | Batchelder et al. | |
| 5,249,094 | A | 9/1993 | Hayakawa et al. | |
| 5,535,089 | A | 7/1996 | Ford et al. | |
| 6,693,788 | B1 | 2/2004 | Partridge | |
| 6,850,403 | B1 | 2/2005 | Gefter et al. | |
| 7,177,133 | B2 | 2/2007 | Riskin | |
| 7,180,722 | B2 | 2/2007 | Jacobs et al. | |
| 7,375,944 | B2 * | 5/2008 | Izaki et al. | 361/230 |
| 7,649,728 | B2 * | 1/2010 | Fujita et al. | 361/213 |

OTHER PUBLICATIONS

Lee W. Young, PCT Internat'l Appn PCT/US08/03488—Internat'l Search Report, Jun. 9, 2009, 1 sheet, International Search Authority, Virginia, US.

* cited by examiner

*Primary Examiner*—Danny Nguyen
(74) *Attorney, Agent, or Firm*—John E. Menear

(57) ABSTRACT

An apparatus and method for minimizing contamination buildup on corona emitters that are employed in an ionizer. Contamination buildup control is accomplished with solely electronic means. High voltage is applied to the emitters with waveforms that serve to push contaminants away from the emitter, rather than attracting contaminants toward the emitters. The results are fewer cleaning cycles, more time between cleaning cycles, and more stable ionizer operation.

25 Claims, 7 Drawing Sheets

PREVENTION OF EMITTER CONTAMINATION WITH ELECTRONIC WAVEFORMS

CROSS-REFERENCE TO RELATED APPLICATIONS

This application claims priority to U.S. Provisional Application 60/918,512 entitled "Method and Apparatus for Control Contamination of Ion Emitters" filed Mar. 17, 2007 by Lawrence Levit and Peter Gefter.

STATEMENT REGARDING FEDERALLY SPONSORED RESEARCH

Not Applicable

REFERENCE TO A MICROFICHE APPENDIX

Not Applicable

BACKGROUND OF THE INVENTION

1. Field of the Invention

This invention relates to AC powered ionizers for that are used for static charge control. More specifically, the invention is targeted at the problem of ion emitter contamination in the AC ionizers, while the ionizer performs useful neutralization.

With AC ionizers, each emitter receives a positive voltage during one time period and a negative voltage during another time period. Hence, each emitter generates both positive and negative ions.

Both positive and negative ions are directed toward a charged target for the purpose of neutralizing the charge.

2. Description of Related Art

Ion emitters generate both positive and negative ions into the surrounding air or gas media. To generate ions, the amplitude of applied AC voltage must be high enough to produce a corona discharge between at least two electrodes, where at least one of them is an ion emitter.

The minimum voltage for the establishment of corona discharge is called corona onset voltage or the corona threshold voltage. According to theoretical and experimental studies of corona discharge this voltage mainly depends upon the ion emitter geometry, polarity of applied voltage, gas composition and pressure [F. W. Peek, "Dielectric Phenomena in High Voltage Engineering" McGraw Hill, New York, 1929 and J. M. Meek and J. D. Craggs "Electrical Breakdown of Gases" John Wiley & Sons, Chichester, 1978].

For wire or filament-type ion emitters, the corona onset voltage is typically in the range of positive 5 to 6 kV for positive ionizing voltage and in the range of negative 4.5 to 5.5 kV for negative ionizing voltage. For point-type ion emitters, the absolute values of onset voltage are typically 1-1.5 kV lower. These stated corona onset voltages apply to clean emitters. If the emitters are not clean, corona onset voltages change.

It is known in art that airborne particles from the surrounding air or gas accumulate on the emitters. Effectively, the emitters are functioning as electrostatic precipitators. Emitter contamination is an expected consequence of corona discharge in open air. Contamination buildup changes the emitter's geometry and raises onset voltage.

Once contaminated, real time ion production decreases, and the efficiency of the AC ionizer decreases significantly. This buildup must be removed to restore proper operation of the ionizer. In large facilities, thousands of emitters are present. Contamination removal becomes a large and objectionable use of resources.

Prior art contamination removal methods include manual brush abrasion and automatic brush abrasion. These methods of mechanical cleaning are effective, but require additional mechanical parts or operator time. In some cases, abrasive cleaning transfers contamination accumulated by ion emitters to the product, which must be kept clean.

A new method is needed to reduce the contamination deposition rate on the ion emitters. Ideally, the method would arise from basic physics or electronics, and operate without taking the ionizer out of service.

Further, the contamination prevention method should apply to a variety of emitter configurations: points, wires, filaments, or loops.

BRIEF SUMMARY OF THE INVENTION

Particles or large molecules, which are convertible into particles, exist in the atmosphere of a cleanroom. When a prior art ionizer is operated within the cleanroom, particles accumulate on the emitters because the particles are drawn toward the emitter by the electric field emanating from the emitter.

This instant invention reduces contamination buildup on emitters within AC ionizers. The novel principle lies in the application of voltage waveforms onto the emitters through programmed power supplies. These electrical waveforms, when applied to the emitter points, drive particles away from the emitter electrode(s) rather than attract particles to the emitter electrode(s).

The instant invention is solely an electronic method of preventing contamination buildup on the emitters. The invention does not require air flow or mechanical components to function. However, this invention may be combined with air flow or mechanical components.

There are two dominant mechanisms of particle attraction to emitters: (1) Coulombic attraction and (2) dielectrophoretic attraction. Both attraction mechanisms can be understood in relation to fundamental physical forces.

Coulombic forces can be attractive or repulsive. Coulombic particle attraction occurs when a particle is positive and the emitter is negative. Alternately, a particle is negative and the emitter is positive. Invented waveforms are designed to minimize attractive Coulombic forces and maximize repulsive Coulombic forces.

The second force is the dielectrophoretic attraction. This force operates whenever an asymmetric electric field is present, but ceases operation when the asymmetric electric field ceases. Asymmetric electric fields exist near ionizer emitters, regardless of whether the emitter is a pointed shaft, a wire filament, a loop, or alternate shape.

Dielectrophoretic force has two unique properties. First, the dielectrophoretic force on a particle is always attractive in air, nitrogen, or inert gas. Second, the dielectrophoretic force operates on neutral particles.

The invented electronic waveforms, which are delivered to the emitters through one or more high voltage power supplies, are combinations of some or all of the following components:

- ion generation signal amplified to an ion generation voltage such that peak voltages exceed the corona onset voltage,
- positive cleaner signal amplified to a positive cleaner voltage that repels positive particles,
- negative cleaner signal amplified to a negative cleaner voltage that repels negative particles, positive ion driver signal amplified to a positive ion driver voltage that drives positive ions toward the target, negative ion driver signal amplified to a negative ion driver voltage that drives negative ions toward the target, and an OFF period.

DETAILED DESCRIPTION OF THE INVENTION

The present invention applies to all ionizers with corona emitters, and is particularly useful for ionizing bars. The invention is an electronic method to prevent contamination buildup on corona emitters.

Electronic waveforms are applied to an ionizer's corona emitters through the high voltage power supplies. The waveforms are designed to accomplish two goals. The first goal is to generate ions and deliver them to a charged target. The second goal is to reduce contamination buildup on the corona emitters.

Figure 1:
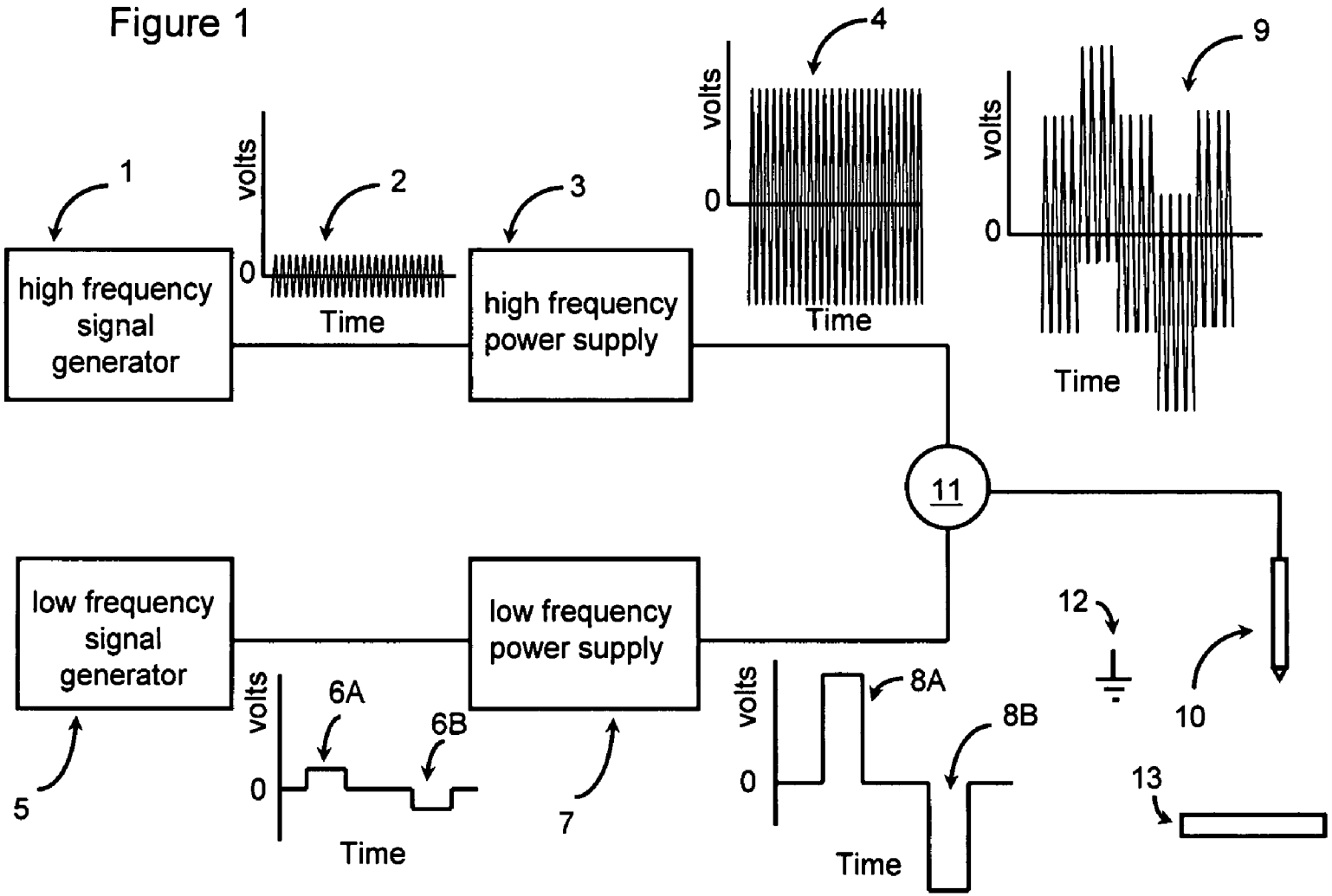
FIG. 1 shows the electronics and ionizing waveform for an ionizer designed for discharging targets that are close to the ionizer.

FIG. 1 diagrams a first embodiment of the electronics for an ionizer with reduced contamination of corona emitters. The system shown in FIG. 1 is appropriate for charged targets 13 which are within 6 inches of the ionizer.

A high frequency signal generator 1 produces an ion generation signal 2 that is fed to the input of a high-frequency power supply 3 that produces a high voltage output. The high frequency power supply 3 amplifies the ion generation signal 2 to create an ion generating voltage 4.

Simultaneously, a low frequency signal generator 5 produces a positive cleaner signal 6A and a negative cleaner signal 6B, which are fed to the input of a low frequency power supply 7 that produces a high voltage output. The low frequency power supply 7 amplifies the positive cleaner signal 6A and negative cleaner signal 6B to create a positive cleaner voltage 8A and negative cleaner voltage 8B.

The ion generating voltage 4, the positive cleaner voltage 8A, and negative cleaner voltage 8B combine in a summing block 11 to create the ionizing waveform 9. The ionizing waveform 9 is connected to the emitter 10. Reference electrode 12 provides a ground reference.

FIG. 1 shows two signal generators and two power supplies, but more or fewer signal generators and power supplies may be used.

During time periods where only the ion generation signal 2 is applied and no charged target 13 is nearby, a steady state density of balanced ions is created in the vicinity of the emitter 10. The reason is that the frequency of the ion generation signal 2 is roughly 1,000 to 100,000 Hertz, with a typical frequency of 20,000 Hertz.

At 20,000 Hertz, ions do not have sufficient time to escape before the polarity of the emitter reverses. Hence, the created ions oscillate in a volume of space near the emitter 10. A particle that approaches the emitter 10 will be quickly neutralized, and experience neither Coulombic attraction or Coulombic repulsion.

Figure 2:
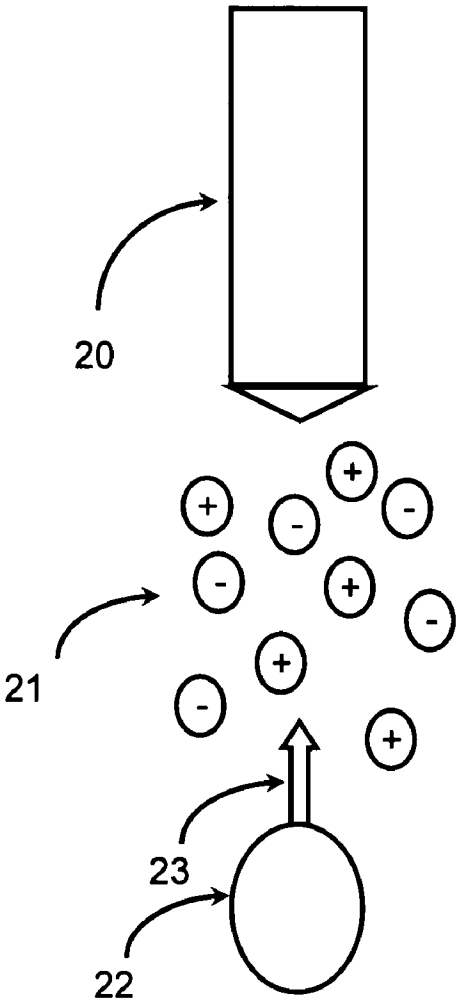
FIG. 2 shows a corona emitter surrounded by balanced ions and a neutral particle. This condition exists when the ionizing waveform incorporates only a balanced ion generating signal.

FIG. 2 describes the volume of space near an emitter 20 when only the ion generation signal is applied. The ions 21 near the emitter are balanced because the ion generation signal has a mean voltage of zero. A particle 22 near the emitter 20 is neutral because neither the emitter 20 nor the ions 21 have a net charge. Hence, there is no Coulombic force that attracts the particle 22 toward the emitter 20. Only a dielectrophoretic force 23 acts to move the particle 22 toward the emitter 20.

Figure 3:
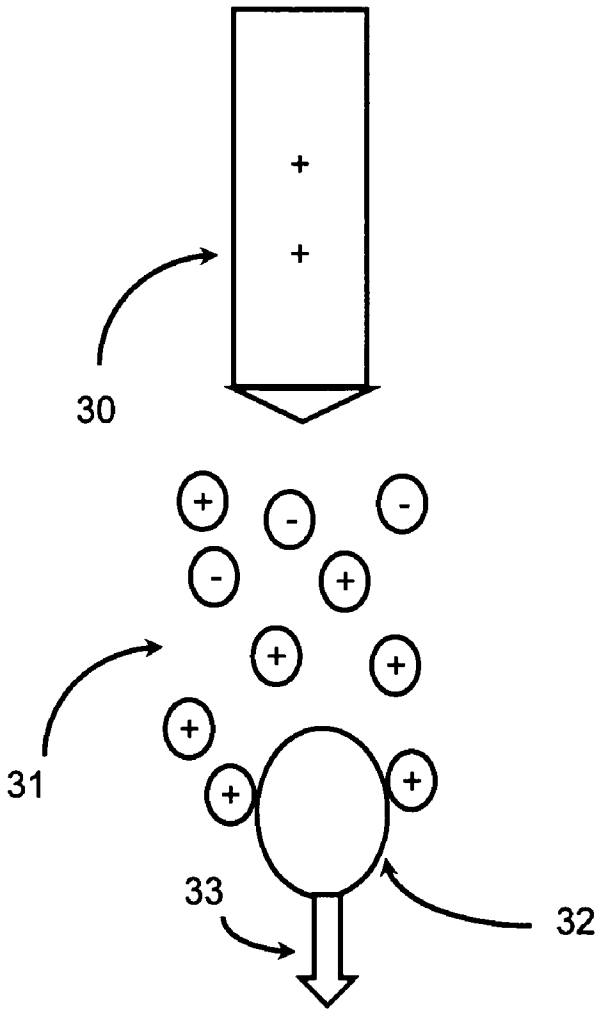
FIG. 3 shows a corona emitter when the ionizing waveform incorporates both a balanced ion generating signal and a positive cleaner signal. A nearby particle acquires a positive charge, and is repelled by Coulombic force.

Refer to FIG. 3. This situation changes when a positive cleaner signal is applied. The emitter 30 now acquires a positive voltage, relative to a ground reference. The positive charged emitter 30 imbalances the ions 31. More positive ions than negative ions are present. A particle 32 equilibrates with the positive distribution of ions 31, and becomes positive itself. The positive particle 32 now experiences Coulombic repulsion, and moves away from the positive emitter 30 along repulsion direction 33. Movement of 0.1 centimeter is sufficient to prevent recapture. The probability of this particle 32 contaminating the emitter 30 has been minimized by the application of the positive cleaner signal.

Figure 4:
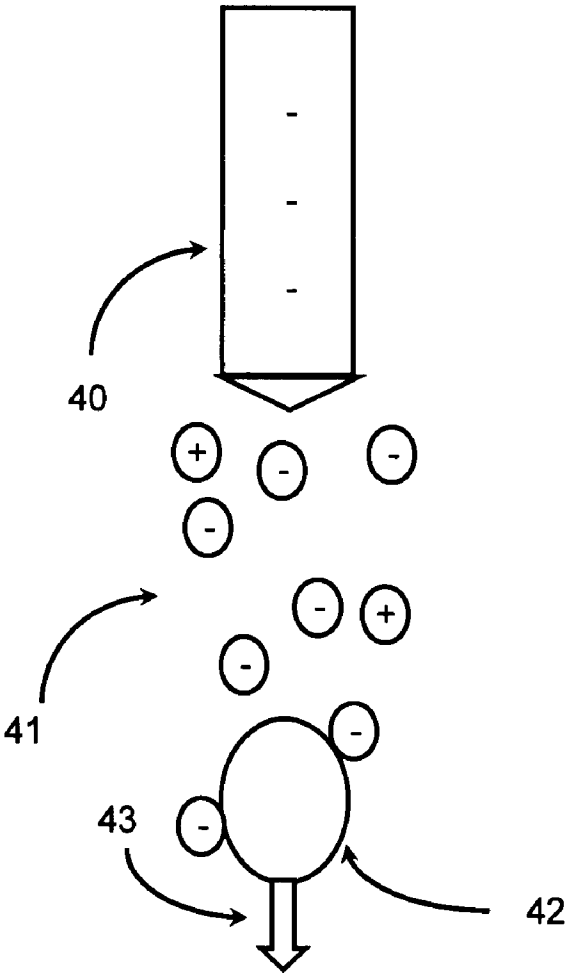
FIG. 4 shows a corona emitter when the ionizing waveform incorporates both a balanced ion generating signal and a negative cleaner signal. A nearby particle acquires a negative charge, and is repelled by Coulombic force.

Refer to FIG. 4. When a negative cleaner signal is applied, a particle 42 is repelled for the same reasons. Only the polarity is different. The emitter 40 now acquires a negative voltage, relative to a ground reference. The negative charged emitter 40 imbalances the ions 41. More negative ions than positive ions are present. The particle 42 equilibrates with the negative distribution of ions 41, and becomes negative itself. The negative particle 42 now experiences Coulombic repulsion, and moves away from the negative emitter along repulsion direction 43. Again, the chance of the particle 42 contaminating the emitter 40 is minimal.

The reason for using both positive cleaner signals and negative cleaner signals is to maintain overall ionizer balance. Cleaner signals typically have a frequency of 0.1 to 200 Hertz. The ion generation signal is typically run by itself after a positive cleaner signal or a negative cleaner signal to achieve neutralization of the particles.

When the ionizer is disposed further from a charged target, positive ion driver signals and negative ion driver signals may be incorporated into an ionizing waveform. The purpose is to push ions toward the target.

Figure 5:
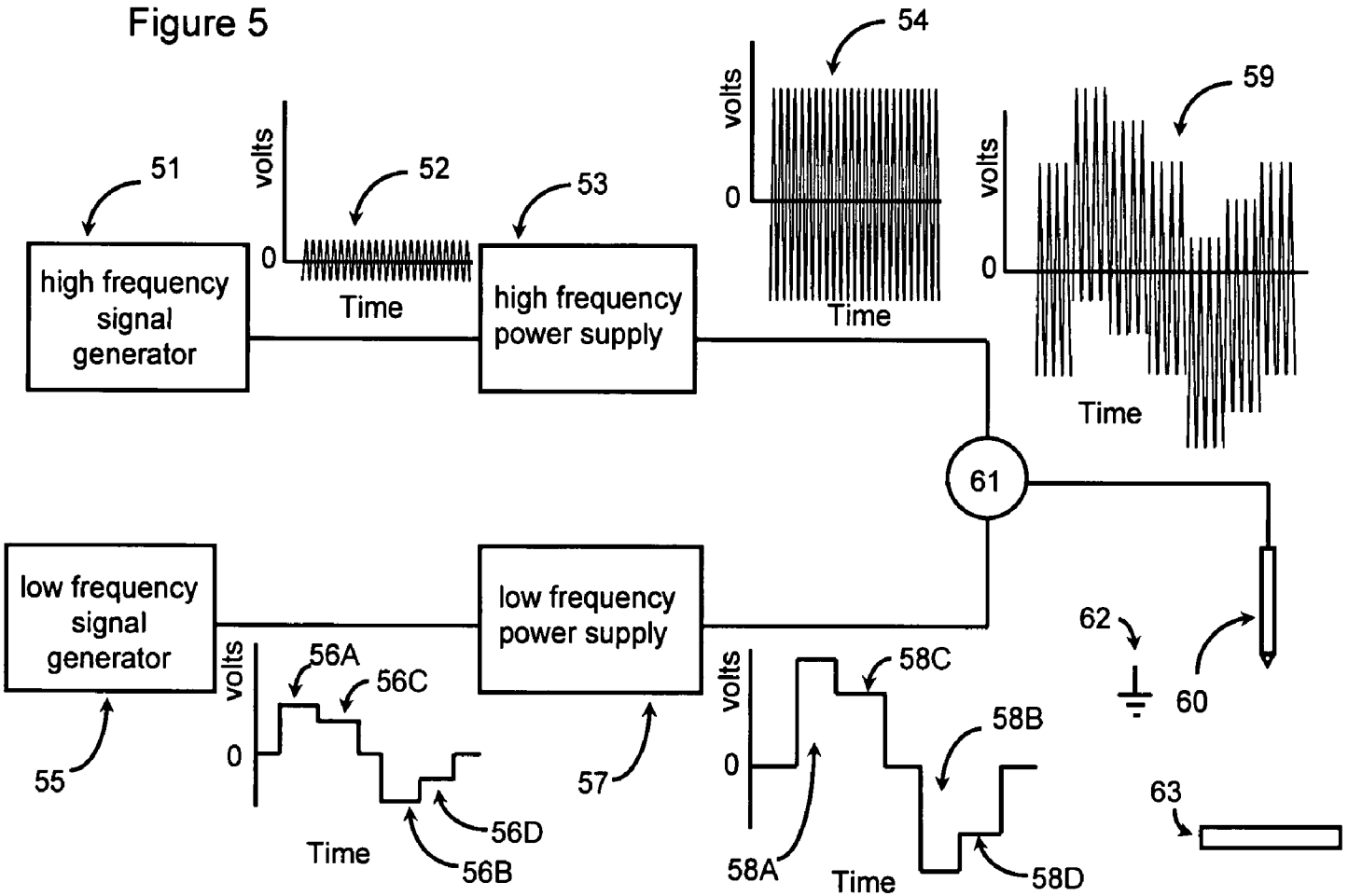
FIG. 5 shows the electronics and ionizing waveform for an ionizer embodiment, where the ionizing waveform incorporates both cleaner signals and ion driver signals.

FIG. 5 shows another embodiment of the electronics for an ionizer with reduced contamination of corona emitters. This embodiment is appropriate for a charged target more than 6 inches away from the ionizer.

In FIG. 5, a high frequency signal generator 51 produces an ion generation signal 52 that is fed to the input of a high-frequency power supply 53 that produces a high voltage output. The high frequency power supply 53 amplifies the ion generation signal 52 to create an ion generating voltage 54.

Simultaneously, a low frequency signal generator 55 produces a positive cleaner signal 56A, a negative cleaner signal 56B, a positive ion driver signal 56C, and a negative ion driver signal 56D, which are fed to the input of a low frequency power supply 57 that produces a high voltage output. The low frequency power supply 57 amplifies the positive cleaner signal 56A, the negative cleaner signal 56B, the positive ion driver signal 56C, and the negative ion driver signal 56D to create a positive cleaner voltage 58A, a negative cleaner voltage 58B, a positive ion driver voltage 58C, and a negative ion driver voltage 58D.

The ion generating voltage 54, the positive cleaner voltage 58A, the negative cleaner voltage 58B, the positive ion driver voltage 58C, and the negative ion driver voltage 58D combine in a summing block 61 to create the ionizing waveform 59. The ionizing waveform 59 is connected to the emitter 60 which operates in relation to a reference electrode 62.

The positive cleaner signal 56A is designed to move particles from the vicinity of the emitter via Coulombic repulsion. The positive ion driver signal 56C is designed to move positive ions toward the charged target 63. The positive cleaner signal 56A and the positive ion driver signal 56C have the same polarity, but magnitudes and durations may be different. Normally, the amplitude of the positive ion driver signal 56C is less than the amplitude of the positive cleaner signal 56A because ions are more mobile than particles. However, this is not a requirement.

Figure 6:
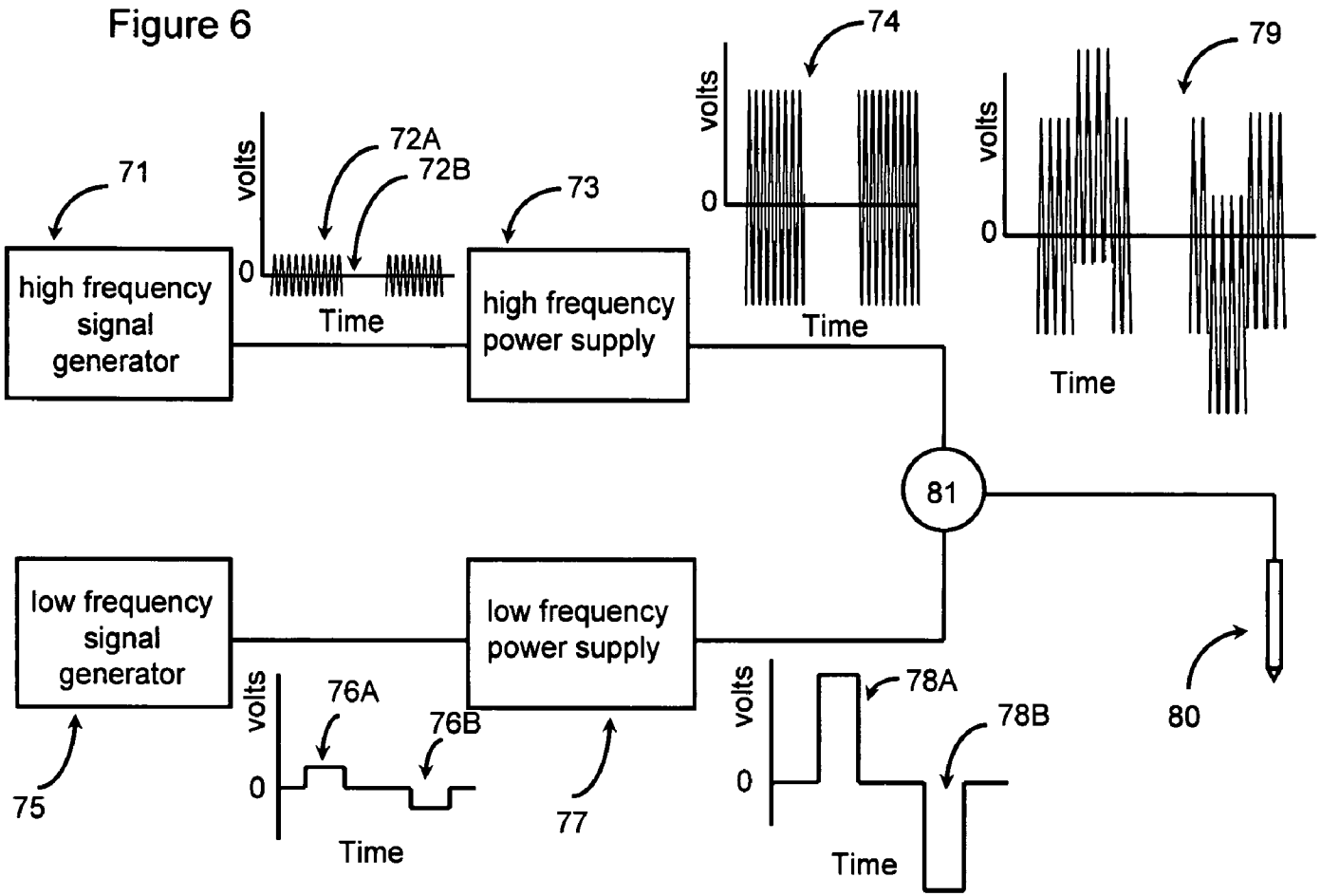
FIG. 6 shows the electronics and ionizing waveform for an ionizer embodiment, where the ionizing waveform incorporates cleaner signals and a period when ions are not generated.

FIG. 6 shows the introduction of periods where the emitters generate no ions. The introduction of non-generating periods has very minor effect on the ionizer's performance. However, there are several benefits. First, power consumption is reduced. Second, ozone generation is reduced. Third, emitter erosion is reduced. Fourth, a reduced duty cycle further reduces the particle generation.

Fifth, dielectrophoretic attraction of neutral particles toward the emitter is reduced, which further reduces contaminant buildup on the emitters. The equation which describes dielectrophoretic attraction is—

$$F_d=4\pi R^3\in_1\{(\in_2-\in_1)/(\in_2+2\in_1)\}E\nabla\cdot E$$

where $\in_1$—permittivity of air or gas surrounding a particle, $\in_2$—particle permittivity, R—radius of the particle and $\nabla\cdot E$ is the field intensity gradient.

Since particles always have higher permittivity than air or gas, the equation shows that, the dielectrophoretic force, $F_d$, is attractive. That is, particles are moved toward the emitter whenever the emitter is charged. Turning the power off interrupts the attractive dielectrophoretic force, and provides time for the particles to be moved away from the emitter by Coulombic repulsion.

For the embodiment in FIG. 6, a high frequency signal generator 71 produces an ion generation signal 72A that is fed to the input of a high-frequency power supply 73 that produces a high voltage output. The high frequency power supply 73 amplifies the ion generation signal 72A to create an ion generating voltage 74. As shown, the ion generation signal 72A is not continuous, and includes an OFF period signal 72B. No ions are generated during the OFF period signal 72B.

Simultaneously in FIG. 6, a low frequency signal generator 75 produces a positive cleaner signal 76A and a negative cleaner signal 76B, which are fed to the input of a low frequency power supply 77 that produces a high voltage output. The low frequency power supply 77 amplifies the positive cleaner signal 76A and negative cleaner signal 76B to create a positive cleaner voltage 78A and negative cleaner voltage 78B.

The ion generating voltage 74, the positive cleaner voltage 78A, and negative cleaner voltage 78B combine in a summing block 81 to create the ionizing waveform 79. The ionizing waveform 79 is delivered to the emitter 80. Note that the ionizing waveform 79 includes a time period in which no ionization occurs, corresponding to OFF period signal 72B.

Figure 7:
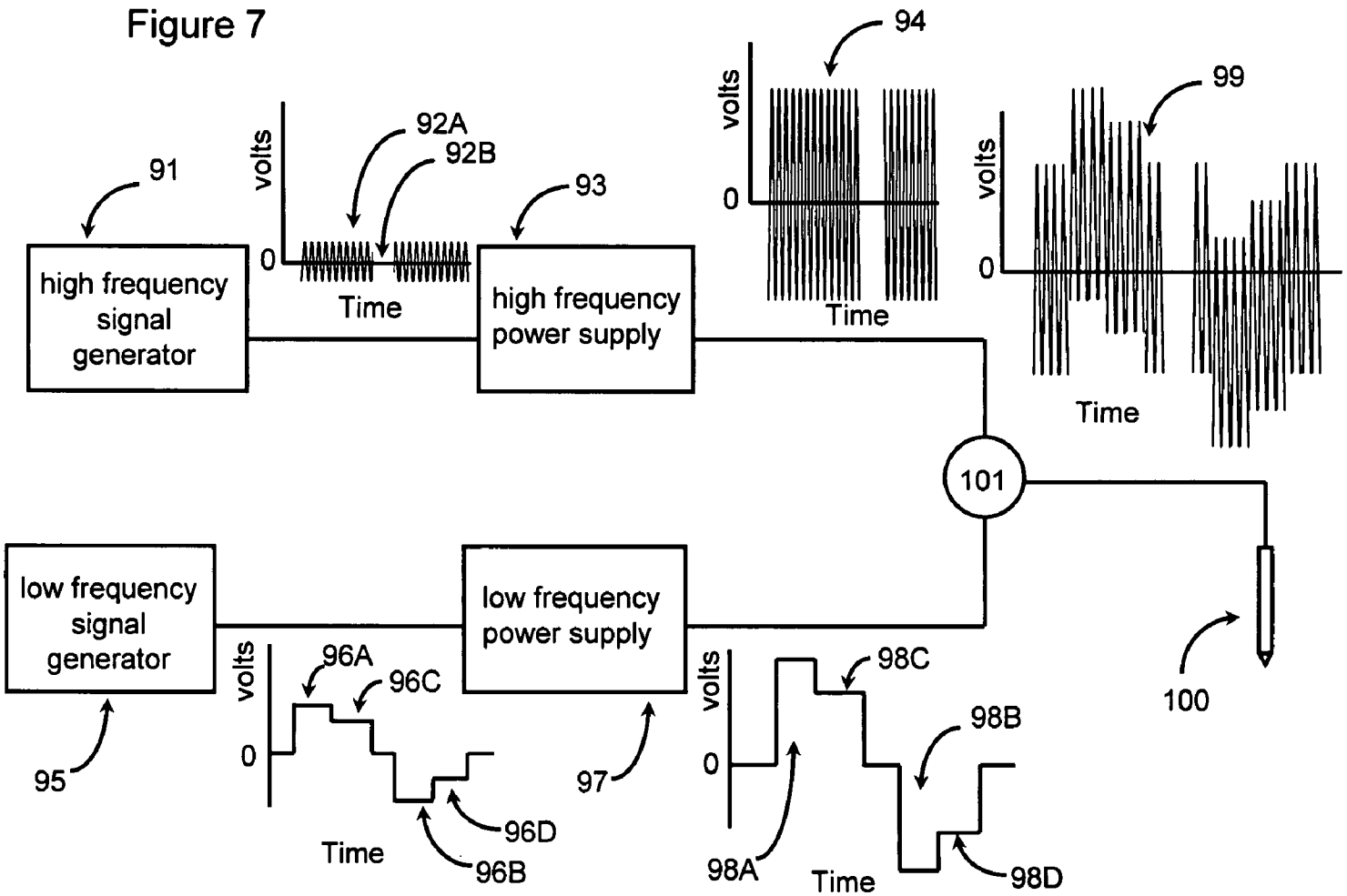
FIG. 7 shows the electronics and ionizing waveform for an ionizer embodiment, where the ionizing waveform incorporates cleaner signals, ion driver signals, and a period when ions are not generated.

FIG. 7 shows an another embodiment using an OFF period 92B which is contained within an ion generation signal 92A. In FIG. 7, a high frequency signal generator 91 produces an ion generation signal 92A that is fed to the input of a high-frequency power supply 93 that produces a high voltage output. The high frequency power supply 93 amplifies the ion generation signal 92 to create an ion generating voltage 94.

Simultaneously, a low frequency signal generator 95 produces a positive cleaner signal 96A, a negative cleaner signal 96B, a positive ion driver signal 96C, and a negative ion driver signal 96D, which are fed to the input of a low frequency power supply 97 that produces a high voltage output. The low frequency power supply 97 amplifies the positive cleaner signal 96A, the negative cleaner signal 96B, the positive ion driver signal 96C, and the negative ion driver signal 96D to create a positive cleaner voltage 98A, a negative cleaner voltage 98B, a positive ion driver voltage 98C, and a negative ion driver voltage 98D.

The ion generating voltage 94, the positive cleaner voltage 98A, the negative cleaner voltage 98B, the positive ion driver voltage 98C, and the negative ion driver voltage 98D combine in a summing block 101 to create the ionizing waveform 99. The ionizing waveform 99 is connected to the emitter 100.

The positive cleaner signal 96A is designed to move particles from the vicinity of the emitter via Coulombic repulsion. The positive ion driver signal 96C is designed to move positive ions toward the charged target. The positive cleaner signal 96A and the positive ion driver signal 96C have the same polarity, but magnitudes and durations may be different. Normally, the amplitude of the positive ion driver signal 96C is less than the amplitude of the positive cleaner signal 96A because ions are more mobile than particles. However, this is not a requirement.

The negative cleaner signal 96B and the negative ion driver signal 96D perform the same functions as the positive cleaner signal 96A and the positive ion driver signal 96C, but use a negative polarity.

The ion generation signal is typically run by itself after a positive ion driver signal 96C or a negative ion driver signal 96D.

The ionizing waveform 99 shows a period where no ions are generated.

For cost and space considerations, it is desirable to reduce the number of signal generators and power supplies. This can be done by combining the low frequency signals with one low frequency signal generator, and forwarding the combined signal to one low frequency power supply. Similarly, high frequency signals can be processed by one high frequency signal generator, and forwarded to one high frequency power supply.

Signal time period durations, sequence orders, and voltage amplitudes are variable, depending on the type and concentration of airborne contaminants near the ionizer. Furthermore, signals may have shapes beyond square waves. Rounded, trapezoidal, triangular, or asymmetric are applicable. Such variation is within the scope of this invention.

We claim:

1. An apparatus for neutralizing static charge on a charged target incorporating corona emitters that resist contamination buildup comprising:

one more signal generators where, said signal generators produce at least one bipolar ion generation signal, at least one positive cleaner signal, and at least one negative cleaner signal;

one or more high voltage power supplies, which receive signals from said signal generators, which amplify said ion generation signal to an ion generation voltage, which amplify said positive cleaner signal to a positive cleaner voltage, and which amplify said negative cleaner signal to a negative cleaner voltage;

a summing block which combines said ion generation voltage, said positive cleaner voltage, and said negative cleaner voltage to create an ionization waveform, where said ionization waveform minimizes contamination buildup on said emitters; and an electrical connection between said emitters and said summing block.

2. The apparatus of claim 1, the apparatus comprising an AC ionizing bar is positioned less than 6 inches from the target to be neutralized.

3. The apparatus of claim 1 where said ion generation signal has a frequency between 1000 and 100000 Hertz, and said ion generation voltage creates equal numbers of positive and negative ions.

4. The apparatus of claim 1 where said positive cleaner signal or said negative cleaner signal has a frequency between 0.1 and 200 Hertz.

5. The apparatus of claim 1 where said ionization waveform is a periodic sequence comprising:

said ionizing voltage alone in a first time period;

said ionizing voltage plus said positive cleaner voltage in a second time period;

said ionizing voltage alone in a third time period; and said ionizing voltage plus said negative cleaner voltage in a forth time period.

6. An apparatus for neutralizing static charge on a charged target incorporating corona emitters that resist contamination buildup comprising:

one more signal generators where, said signal generators produce at least one ion generation signal, at least one positive cleaner signal, at least one negative cleaner signal, at least one positive ion driver signal, and at least one negative ion driver signal;

one or more high voltage power supplies, which receive signals from said signal generators, which amplify said ion generation signal to an ion generation voltage, which amplify said positive cleaner signal to a positive cleaner voltage, which amplify said negative cleaner signal to a negative cleaner voltage, which amplify said positive ion driver signal to a positive ion driver voltage, and which amplify said negative ion driver signal to a negative ion driver voltage;

a summing block which combines said ion generation voltage, said positive cleaner voltage, said negative cleaner voltage, said positive ion driver voltage, and said negative ion driver voltage to create an ionization waveform, where said ionization waveform minimizes contamination buildup on said emitters; and an electrical connection between said emitters and said summing block.

7. The apparatus of claim 6, the apparatus comprising an AC ionizing bar is positioned more than 6 inches from the target to be neutralized.

8. The apparatus of claim 6 where said ion generation signal has a frequency between 1000 and 100000 Hertz, and said ion generation voltage creates equal numbers of positive and negative ions.

9. The apparatus of claim 6 where said positive cleaner signal, said negative cleaner signal, said positive ion driver signal, or said negative ion driver signal has a frequency between 0.1 and 200 Hertz.

10. The apparatus of claim 6 where said ionization waveform is based on a periodic sequence comprising:

said ionizing voltage alone in a first time period;

said ionizing voltage plus said positive cleaner voltage in a second time period;

said ionizing voltage plus said positive ion driver voltage in a third time period;

said ionizing voltage alone in a forth time period;

said ionizing voltage plus said negative cleaner voltage in a fifth time period; and said ionizing voltage plus said negative ion driver voltage in a sixth time period.

11. An apparatus for neutralizing static charge on a charged target incorporating emitters that resist contamination buildup comprising:

one more signal generators where, said signal generators produce at least one ion generation signal, at least one positive cleaner signal, at least one negative cleaner signal, at least one positive ion driver signal, at least one negative ion driver signal, and at least one OFF signal;

one or more high voltage power supplies, which receive signals from said signal generators, which amplify said ion generation signal to an ion generation voltage, which amplify said positive cleaner signal to a positive cleaner voltage, which amplify said negative cleaner signal to a negative cleaner voltage, which amplify said positive ion driver signal to a positive ion driver voltage, which amplify said negative ion driver signal to a negative ion driver voltage, and which produce a zero output voltage during the period of said OFF signal;

a summing block which combines said ion generation voltage, said positive cleaner voltage, said negative cleaner voltage, said positive ion driver voltage, said negative ion driver voltage, and said OFF period to create an ionization waveform, where said ionization waveform minimizes contamination buildup on said emitters; and an electrical connection between said emitters and said summing block.

12. The apparatus of claim 11, the apparatus comprising an AC ionizing bar is positioned less than 6 inches from the target to be neutralized.

13. The apparatus of claim 11 where said ion generation signal has a frequency between 1000 and 100000 Hertz, and said ion generation voltage creates equal numbers of positive and negative ions.

14. The apparatus of claim 11 where said positive cleaner signal, said negative cleaner signal, said positive ion driver signal, said negative ion driver signal, or said OFF signal has a frequency between 0.1 and 200 Hertz.

15. The apparatus of claim 11 where said ionization waveform is based on a periodic sequence comprising:

said ionizing voltage alone in a first time period;

said ionizing voltage plus said positive cleaner voltage in a second time period;

said ionizing voltage plus said positive ion driver voltage in a third time period;

said zero output voltage in a forth time period said ionizing voltage alone in a fifth time period;

said ionizing voltage plus said negative cleaner voltage in a sixth time period; and said ionizing voltage plus said negative ion driver voltage in a seventh time period.

16. A method of generating ions for static charge removal and simultaneously minimizing contamination buildup on corona emitters comprising:

creating signals from one or more signal generators where said signals include at least one ion generation signal, at least one positive cleaner signal, and at least one negative cleaner signal;

inputting said signals to one or more high voltage power supplies, where said ion generation signal is amplified to an ion generation voltage, where said positive cleaner signal is amplified to a positive cleaner voltage, and where said negative cleaner signal is amplified to a negative cleaner voltage;

combining said ion generation voltage, said positive cleaner voltage, and negative cleaner voltage to create an ionizing waveform; and connecting the ionizing waveform to said emitters.

17. The method of claim 16 where said ion generation signal has a frequency between 1000 and 100000 Hertz, and said ion generation voltage creates equal numbers of positive and negative ions.

18. The method of claim 16 where said positive cleaner voltage or said negative cleaner voltage has a frequency between 0.1 and 200 Hertz.

19. The method of claim 16 said ionizing waveform further comprises a positive ion driver voltage or a negative ion driver voltage.

20. The method of claim 16 said ionizing waveform further comprises an OFF period, wherein no voltage is delivered to the emitters.

21. A method of generating ions for static charge removal and simultaneously minimizing contamination buildup on corona emitters comprising:

placing an ionizing waveform onto said corona emitters with one or more high voltage power supplies, where said ionizing waveform incorporates at least one ion generation voltage, at least one positive cleaner voltage, and at least one negative cleaner voltage;

neutralizing particles near the corona emitters when ions are created by said ion generation voltage alone;

repelling particles or contaminants away from said corona emitters with said positive cleaner voltage or said negative cleaner voltage.

22. The method of claim 21 where said ionizing waveform is a periodic sequence comprising:

said ionizing voltage alone in a first time period;

said ionizing voltage plus said positive cleaner voltage in a second time period;

said ionizing voltage alone in a third time period; and said ionizing voltage plus said negative cleaner voltage in a forth time period.

23. The method of claim 21 where said ionizing waveform further includes a positive ion driver voltage, which follows or precedes said positive cleaner voltage; and moves positive ions toward a charged target.

24. The method of claim 21 where said ionizing waveform further includes a negative ion driver voltage, which follows or precedes said negative cleaner voltage; and moves negative ions toward a charged target.

25. The method of claim 21 where said ionizing waveform further includes periods when no voltage is delivered to said emitters, which minimizes the percentage of time during which dielectrophoretic forces attract particles to said emitters.

* * * * *